US009879685B2

(12) United States Patent
Fujioka

(10) Patent No.: US 9,879,685 B2
(45) Date of Patent: Jan. 30, 2018

(54) ROTARY MACHINE, BLADE WHEEL USED IN ROTARY MACHINE, AND BLADE WHEEL MANUFACTURING METHOD

(71) Applicant: Kobe Steel, Ltd., Kobe-shi (JP)

(72) Inventor: Koumei Fujioka, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 640 days.

(21) Appl. No.: 14/173,234

(22) Filed: Feb. 5, 2014

(65) Prior Publication Data

US 2014/0294582 A1 Oct. 2, 2014

(30) Foreign Application Priority Data

Apr. 1, 2013 (JP) ..... 2013-075865

(51) Int. Cl.

| | |
|---|---|
| ***F04D 29/18*** | (2006.01) |
| ***F04D 29/60*** | (2006.01) |
| ***F04D 25/02*** | (2006.01) |
| ***F04D 29/02*** | (2006.01) |
| ***F04D 29/16*** | (2006.01) |
| ***F04D 29/28*** | (2006.01) |

(52) U.S. Cl.

CPC ..... *F04D 25/02* (2013.01); *F04D 29/023* (2013.01); *F04D 29/162* (2013.01); *F04D 29/284* (2013.01); *F05D 2300/44* (2013.01); *F05D 2300/611* (2013.01); *Y10T 29/49325* (2015.01)

(58) Field of Classification Search

CPC ..... F04D 25/02; F04D 29/162; F04D 29/023; F04D 29/284; F05D 2300/44; F05D 2300/611; Y10T 29/49325

See application file for complete search history.

(56) References Cited

FOREIGN PATENT DOCUMENTS

| | | | |
|---|---|---|---|
| GB | 1390797 | * | 4/1975 |
| JP | 401008385 | * | 1/1989 |
| JP | 64-73197 A | | 3/1989 |
| JP | H03-10040 U | | 1/1991 |
| JP | H08-296590 A | | 11/1996 |
| JP | 2001-317492 | | 11/2001 |
| JP | 2008-223660 A | | 9/2008 |
| JP | 2008-303854 | | 12/2008 |
| JP | 2009-041066 | | 2/2009 |
| JP | 2012-025986 | | 2/2012 |

* cited by examiner

*Primary Examiner* — John C Hong
(74) *Attorney, Agent, or Firm* — Oblon, McClelland, Maier & Neustadt, L.L.P.

(57) ABSTRACT

A compressor of the present invention includes an impeller that is rotatably provided inside an accommodation portion of a compressor casing, the impeller includes a blade that extends toward an inner peripheral surface of the accommodation portion, and an outer edge of the blade facing the inner peripheral surface of the accommodation portion is provided with a shroud portion that is formed from a resin layer. With such a configuration, the wear damage of the casing and the blade of the blade wheel may be prevented, and the effort and the time in the manufacturing process may be reduced.

6 Claims, 5 Drawing Sheets

ROTARY MACHINE, BLADE WHEEL USED IN ROTARY MACHINE, AND BLADE WHEEL MANUFACTURING METHOD

BACKGROUND OF THE INVENTION

Field of the Invention

The present invention relates to a rotary machine, a blade wheel used in a rotary machine, and a blade wheel manufacturing method.

Description of the Related Art

Hitherto, a rotary machine with a rotatable blade wheel is known, and JP 2001-317492 A discloses a centrifugal compressor as an example of the rotary machine. The centrifugal compressor includes a casing and an impeller that corresponds to a blade wheel rotatably provided inside the casing.

The casing includes a tapered inner peripheral surface that increases in diameter as it goes from one end of the impeller in the axial direction toward the other end thereof. The impeller includes a plurality of blades that extend toward the inner peripheral surface of the casing, and each blade includes an outer edge that faces the inner peripheral surface of the casing.

In the inner peripheral surface of the casing, a portion on the upstream side (air flow suction side) is coated with a soft resin. Accordingly, even when the impeller rotates while being deviated in the radial direction, only the resin coating is cut by the blade of the impeller, so that the contact between the blade and the inner peripheral surface of the casing is prevented.

SUMMARY OF THE INVENTION

In the above-described configuration of the related art, the wear damage caused by the contact between the blade and the casing may be reduced. However, since there is a need to handle a large casing for the resin coating, it takes an effort and a time in the manufacturing process.

The present invention is made to solve the above-described problems, and an object thereof is to prevent the wear damage of the blade of the blade wheel and the casing and to reduce the effort and the time in the manufacturing process.

In order to attain the above-described object, a rotary machine according to the present invention includes: a casing; and a blade wheel that is rotatably provided inside the casing, wherein the blade wheel includes: a blade that extends toward an inner peripheral surface of the casing; and a shroud portion that is formed in at least a part of an edge of the blade facing the inner peripheral surface of the casing and is formed from a resin layer.

In the rotary machine, even when the resin layer of the shroud portion contacts the inner peripheral surface of the casing during the rotation of the blade wheel, the contact of the blade with respect to the inner peripheral surface of the casing may be prevented. As a result, the wear damage of the blade may be prevented. Further, since the resin layer is softer than metal, the wear damage of the casing contacting the resin layer may be also prevented. Further, in order to prevent the wear damage of the casing and the blade of the blade wheel, a method may be considered in which the resin layer is formed on the inner peripheral surface of the casing as in the related art. However, in this case, a large casing needs to be handled in the resin layer formation process, and hence it takes the effort and the time in the manufacturing process. On the contrary, in this configuration, since the resin layer may be formed on the blade of the blade wheel that is smaller than the casing and is easily handled, the effort and the time in the manufacturing process may be reduced.

In the rotary machine, the shroud portion may be formed in the entire edge of the blade.

According to this configuration, the wear damage of the casing and the blade of the blade wheel may be further reliably prevented.

In the rotary machine, at least a part of the shroud portion may contact the inner peripheral surface of the casing.

In this configuration, it is possible to remove the gap between the inner peripheral surface of the casing and the blade at the position where the shroud portion contacts the inner peripheral surface of the casing. For this reason, for example, in a case where the rotary machine is a compressor and the blade wheel is an impeller for compressing a gas, the gas compression efficiency may be improved. For example, in a case where the rotary machine is a turbine and the blade wheel is a turbine runner rotated by a steam pressure, it is possible to improve the efficiency in which the steam pressure is converted into power.

In the rotary machine, the edge of the blade may include a radial facing portion that faces the inner peripheral surface of the casing in the radial direction of the blade wheel, and the radial facing portion may be provided with the shroud portion.

According to this configuration, even when the blade wheel rotates while being deviated in position in the radial direction, it is possible to prevent the blade from contacting the inner peripheral surface of the casing by the resin layer. Accordingly, in this configuration, even when the blade wheel rotates while being deviated in position in the radial direction, the wear damage of the casing and the blade of the blade wheel may be prevented.

In the rotary machine, the edge of the blade may include an axial facing portion that faces the inner peripheral surface of the casing in the axial direction of the blade wheel, and the axial facing portion may be provided with the shroud portion.

According to this configuration, even when the blade wheel rotates while being deviated in position in the axial direction, it is possible to prevent the blade from contacting the inner peripheral surface of the casing by the resin layer. Accordingly, in this configuration, even when the blade wheel rotates while being deviated in position in the axial direction, the wear damage of the casing and the blade of the blade wheel may be prevented.

A blade wheel according to the present invention is a blade wheel that is used in the rotary machine.

In the blade wheel, the wear damage of the blade and the casing may be prevented as in the rotary machine, and the effort and the time in the manufacturing process may be reduced.

A blade wheel manufacturing method according to the present invention includes: forming a resin layer on an outer peripheral surface of a base material having the tapered outer peripheral surface; and shaving the blade wheel from the base material subjected to the forming of the resin layer so that the resin layer formed on the outer peripheral surface forms the shroud portion.

In the blade wheel manufacturing method, since the blade of the blade wheel is shaved so that a part of the resin layer formed on the outer peripheral surface of the base material forms the shroud portion, the resin layer of the shroud portion may be easily formed compared to the case where the resin layer is formed on the outer edge of the blade after the blade is formed.

According to the present invention, the wear damage of the casing and the blade of the blade wheel may be prevented, and the effort and the time in the manufacturing process may be reduced.

DESCRIPTION OF THE PREFERRED EMBODIMENTS

Hereinafter, an embodiment of the present invention will be described with reference to the drawings.

Figure 1:
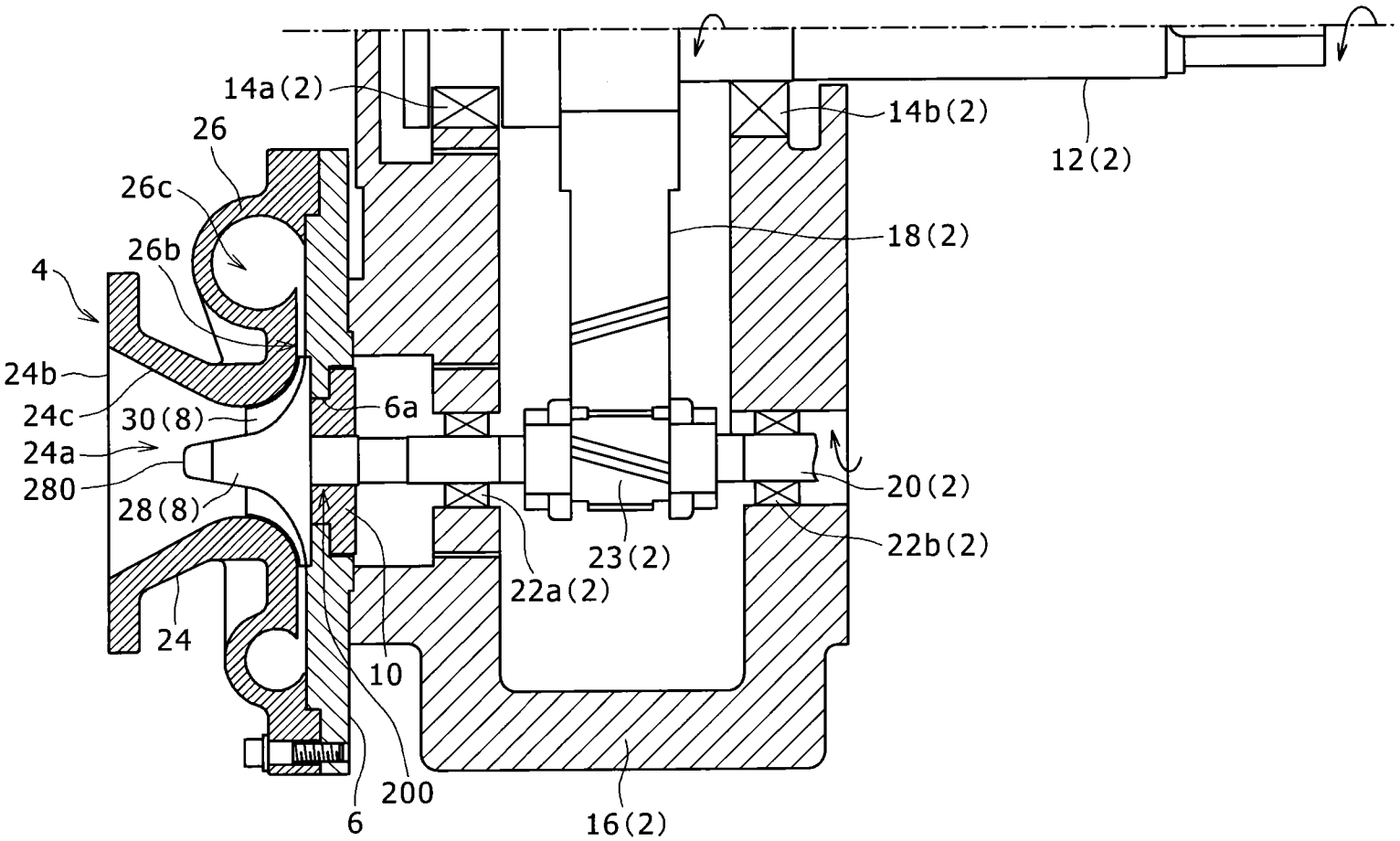
FIG. 1 is a partially cross-sectional view illustrating a compressor according to an embodiment of the present invention.

FIG. 1 is a partially cross-sectional view illustrating a compressor according to this embodiment. The compressor according to this embodiment is an example of the rotary machine of the present invention, and includes a drive mechanism 2, a compressor casing 4, a casing cover 6, an impeller 8, and a seal member 10.

The drive mechanism 2 is used to rotate the impeller 8, and includes a low-speed shaft 12, bearings 14*a* and 14*b*, a motor (not illustrated), a gear casing 16, a low-speed gear 18, a high-speed shaft 20, bearings 22*a* and 22*b*, and a high-speed gear 23.

The low-speed shaft 12 is rotatably supported by the gear casing 16 through the bearings 14*a* and 14*b*. A drive shaft of the motor (not illustrated) is connected to one end of the low-speed shaft 12.

The low-speed gear 18 is fitted to the outside of the low-speed shaft 12 at the position between the bearings 14*a* and 14*b*, and is disposed inside the gear casing 16.

The high-speed shaft 20 is disposed in parallel to the low-speed shaft 12 inside the gear casing 16. The high-speed shaft 20 is rotatably supported by the bearings 22*a* and 22*b*. The left end of the high-speed shaft 20 in FIG. 1 protrudes outward from the gear casing 16.

The high-speed gear 23 is provided at the position between the bearings 22*a* and 22*b* in the high-speed shaft 20, and engages with the low-speed gear 18.

The compressor casing 4 is attached to the left side portion of the gear casing 16 in FIG. 1 through the casing cover 6. In this embodiment, the compressor casing 4 corresponds to the casing of the present invention. The compressor casing 4 includes an accommodation portion 24 that accommodates the impeller 8 and a peripheral portion 26 that is disposed at the outer periphery of the accommodation portion 24 and is integrally formed with the accommodation portion 24.

An inner space 24*a* in which the impeller 8 is disposed is provided inside the accommodation portion 24. Both ends of the inner space 24*a* of the high-speed shaft 20 in the axial direction are opened. Hereinafter, the "axial direction" simply indicates the axial direction of the high-speed shaft 20. Further, the radial direction about the high-speed shaft 20 simply indicates the "radial direction". The casing cover 6 is fastened to the end of the compressor casing 4 near the gear casing 16, and covers the end of the inner space 24*a* near the gear casing 16. A through-hole 6*a* is formed at the center of the casing cover 6, and an end 200 of the high-speed shaft 20 is disposed inside the through-hole 6*a*. The seal member 10 which prevents the leakage of a gas from the inner space 24*a* is provided between the outer peripheral surface of the end 200 of the high-speed shaft 20 and the inner peripheral surface of the through-hole 6*a*. A gas introduction port 24*b* is formed by the end of the inner space 24*a* opposite to the casing cover 6.

Figure 2:
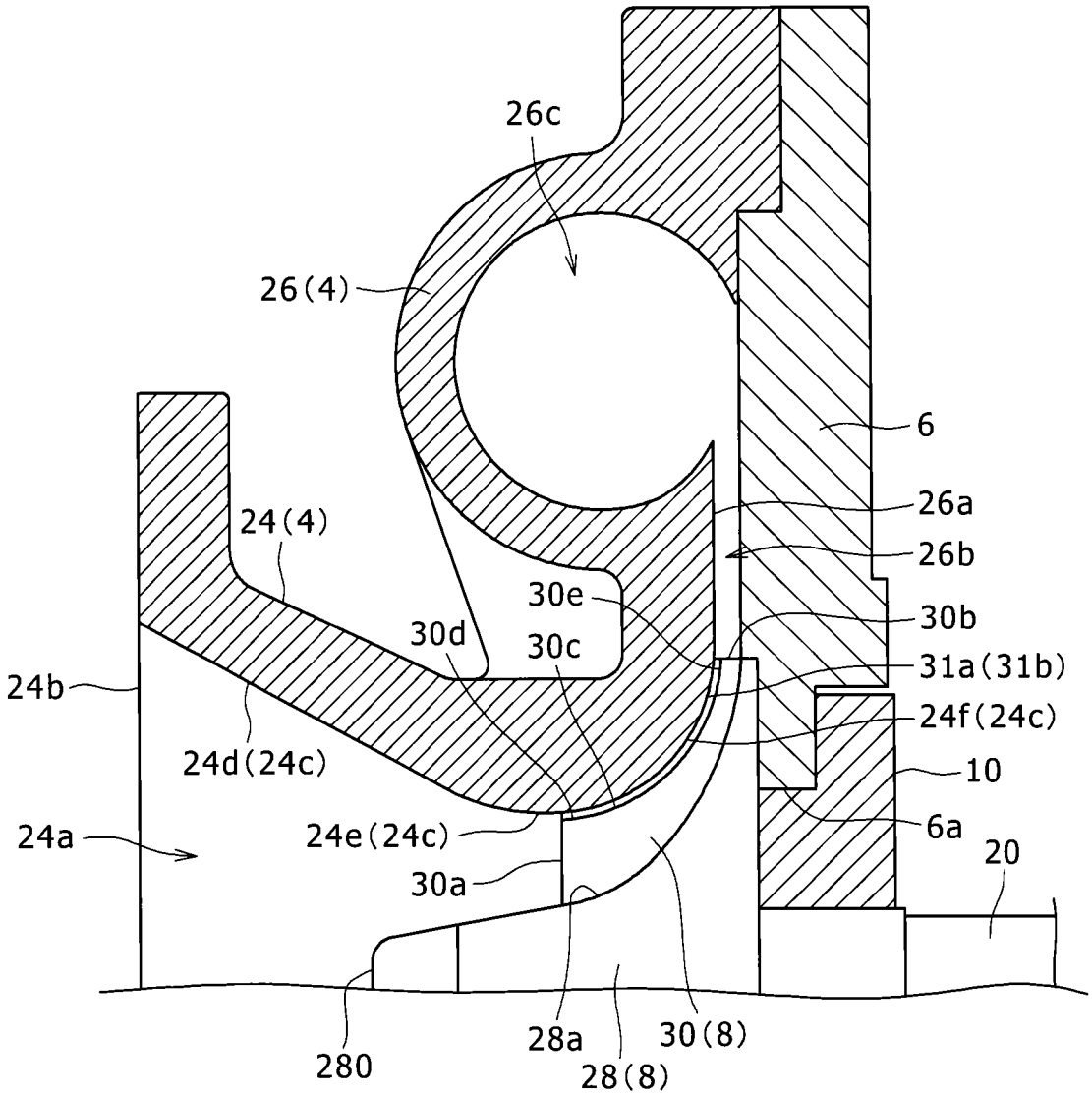
FIG. 2 is a partially enlarged view illustrating the vicinity of a compressor casing and a blade of an impeller of the compressor illustrated in FIG. 1.

FIG. 2 is a partially enlarged view illustrating the vicinity of the compressor casing 4 and blades 30 of the impeller 8 of the compressor. As illustrated in FIG. 2, an inner peripheral surface 24*c* of the accommodation portion 24 forming the inner space 24*a* includes an inlet-side tapered surface 24*d*, an intermediate surface 24*e*, and an outlet-side tapered surface 24*f*.

The inlet-side tapered surface 24*d*, the intermediate surface 24*e*, and the outlet-side tapered surface 24*f* are sequentially disposed from the introduction port 24*b* toward the casing cover 6. The inlet-side tapered surface 24*d* is formed in a tapered shape which decreases in diameter as it goes from the introduction port 24*b* toward the casing cover 6. The intermediate surface 24*e* is formed in a cylindrical shape that extends in the axial direction. The outlet-side tapered surface 24*f* is formed in a tapered shape which increases in diameter so as to perpendicularly approach the axial direction as it goes from the intermediate surface 24*e* toward the casing cover 6.

The peripheral portion 26 includes an end surface 26*a* that extends from the outer edge of the outlet-side tapered surface 24*f* (the edge near the casing cover 6) outward in the radial direction. The end surface 26*a* is perpendicular to the axial direction, and is disposed with a gap between the end surface and the casing cover 6. A communication path 26*b* is formed by the gap between the end surface 26*a* and the casing cover 6. Further, the peripheral portion 26 is provided with a discharge port 26*c* which is connected to the communication path 26*b* and into which the compressed gas is discharged.

Figure 3:
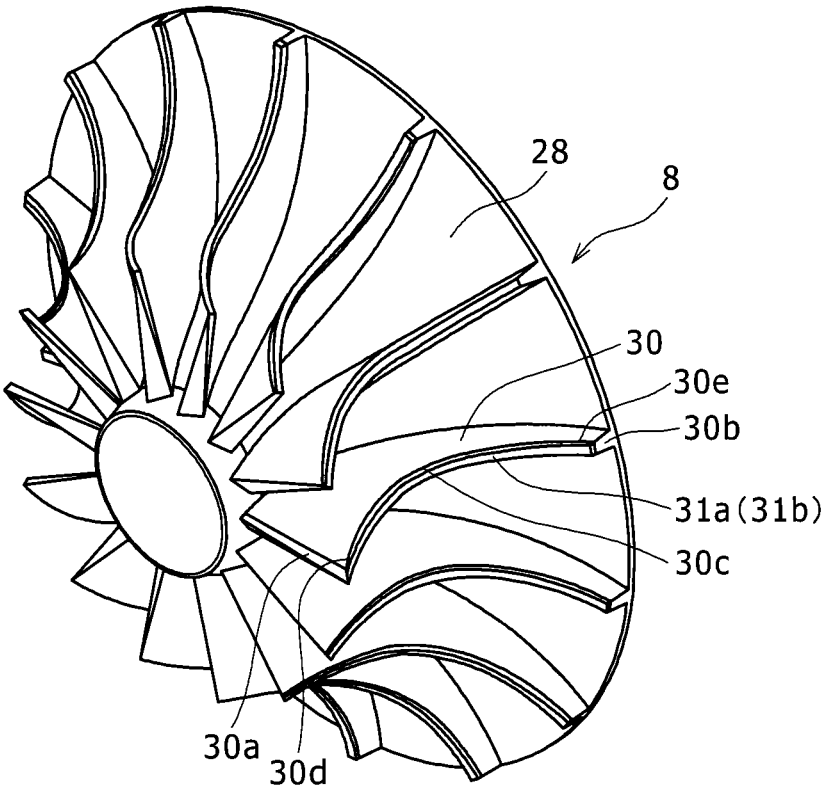
FIG. 3 is a perspective view illustrating the impeller used in the compressor according to the embodiment of the present invention.

As illustrated in FIG. 1, the impeller 8 is rotatably provided while being accommodated in the inner space 24*a* of the accommodation portion 24. The impeller 8 is an example of the blade wheel of the present invention. FIG. 3 is a perspective view of the impeller 8. The impeller 8 includes a hub 28 and the plurality of blades 30.

As illustrated in FIG. 1, the hub 28 is coupled to the end 200 of the high-speed shaft 20 while being disposed so as to be coaxial with the high-speed shaft 20. The hub 28 includes an outer peripheral surface 28*a* (see FIG. 2) that is widened outward in the radial direction as it goes from an apex 280 toward the casing cover 6.

As illustrated in FIG. 3, the plurality of blades 30 protrude from the outer peripheral surface 28*a* of the hub 28 toward the inner peripheral surface 24*c* of the accommodation portion 24, and are disposed with a gap therebetween in the circumferential direction of the hub 28 (the circumferential direction of the impeller 8). The plurality of blades 30 and the hub 28 are integrally formed with one another by a metal material. As illustrated in FIG. 2, the blade 30 is provided in an area facing the vicinity of the outlet-side tapered surface 24*f* of the intermediate surface 24*e* and the outlet-side tapered surface 24*f*. Each blade 30 includes a leading edge 30*a* that is located near the introduction port 24*b* and extends in a direction perpendicular to the axial direction, a trailing edge 30*b* that is located near the discharge port 26*c* and extends in a direction parallel to the axial direction, and an outer edge 30*c* that faces the inner peripheral surface 24*c* of the accommodation portion 24 and is formed in a shape following the inner peripheral surface 24*c*. In the outer edge 30*c*, a portion near the leading edge 30*a* faces the intermediate surface 24*e* of the accommodation portion 24 in the radial direction. Hereinafter, the portion near the leading edge 30*a* is referred to as a radial facing portion 30*d*. In the outer edge 30*c*, a portion near the trailing edge 30*b* faces the outlet-side tapered surface 24*f* of the accommodation portion 24 in the axial direction. Hereinafter, the portion near the trailing edge 30*b* is referred to as an axial facing portion 30*e*.

A shroud portion 31*b* that is formed from a resin layer 31*a* is formed throughout the outer edge 30*c*. The resin layer 31*a* has a thickness of 1 mm to 10 mm. As the material of the resin layer 31*a*, for example, a resin such as PEEK (polyethelethelketon) which has wear resistance and is softer than the metal material forming the blade 30 and the compressor casing 4 is used. In a state where the impeller 8 is stopped, the resin layer 31*a* (shroud portion 31*b*) entirely contacts the inner peripheral surface 24*c* of the accommodation portion 24.

In the compressor with the above-described configuration, in a case where a gas is compressed by the compressor, the low-speed shaft 12 (see FIG. 1) is rotated by the power generated from the motor (not illustrated), and the rotation of the low-speed shaft 12 is transmitted to the high-speed shaft 20 through the low-speed gear 18 and the high-speed gear 23. The high-speed shaft 20 and the impeller 8 rotate together, and the gas that is suctioned from the introduction port 24*b* to the inner space 24*a* of the accommodation portion 24 is compressed by the impeller 8. The compressed gas is discharged through the communication path 26*b* and the discharge port 26*c*.

Figure 4:
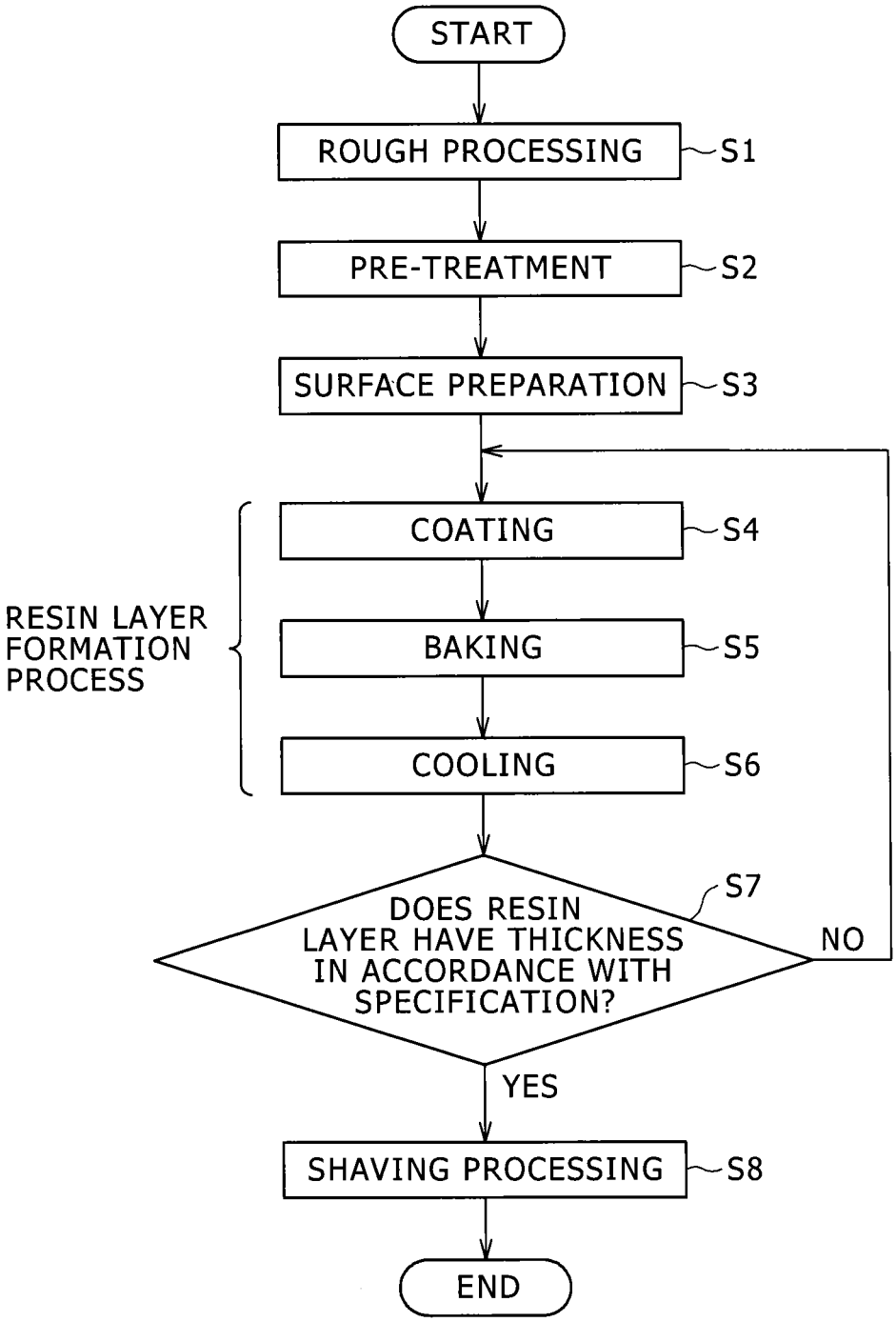
FIG. 4 is a flowchart illustrating an impeller processing procedure.

Next, a process of manufacturing the impeller 8 according to this embodiment will be described based on the flowchart illustrated in FIG. 4.

Figure 5:
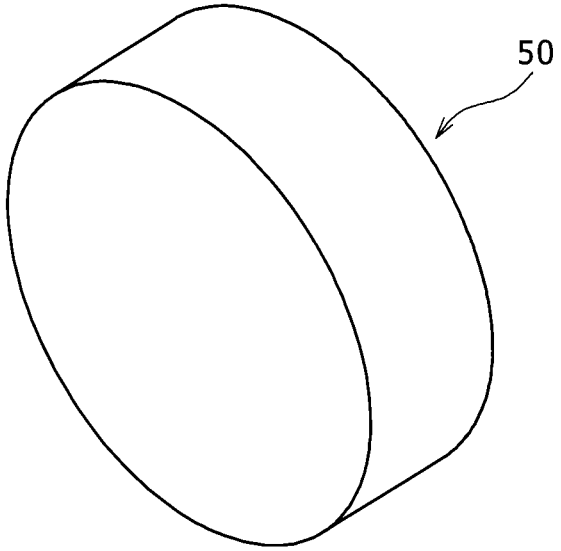
FIG. 5 is a perspective view illustrating a base material that is used to manufacture the impeller.
Figure 6:
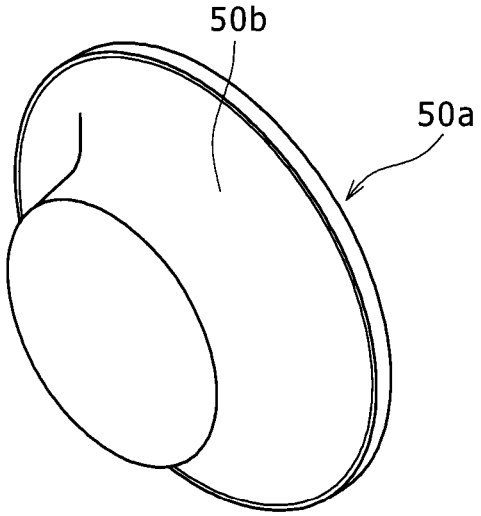
FIG. 6 is a perspective view illustrating a base material subjected to rough processing.

First, a metallic columnar base material 50 (see FIG. 5) is subjected to rough processing (cutting), thereby forming a base material 50*a* having a circular truncated cone shape as illustrated in FIG. 6 (step S1).

Next, a physical and chemical pre-treatment is performed to clean the base material 50*a* (step S2).

Subsequently, a surface preparation is performed on the surface of the base material 50*a* using a surface preparation agent, thereby changing the state of the surface of the base material 50*a* so that a resin may easily adhere to the surface (step S3).

Next, a resin is spray-coated on the tapered outer peripheral surface 50*b* (see FIG. 6) of the base material 50*a* (step S4). Subsequently, the base material 50*a* is baked at a high temperature in a kiln, thereby baking the resin layer (step S5). After the baking, the base material 50*a* is cooled (step S6). The process of step S4 to step S6 is an example of the resin layer formation process of the present invention.

Next, it is checked whether the resin layer has a thickness in accordance with the specification (step S7). When the resin layer has a thickness in accordance with the specification, shaving processing is performed which shaves the impeller 8 (see FIG. 3) from the base material 50*a* (step S8). Meanwhile, when the resin layer does not have a thickness in accordance with the specification, the process after the spray-coating (step S4) is performed again. In the shaving processing, the plurality of blades 30 and the hub 28 are shaved by cutting a portion corresponding to the gap between the blades 30 in the base material 50*a* so that the resin layer formed on the outer peripheral surface 50*b* of the base material 50*a* forms the resin layer 31*a* of the shroud portion 31*b*. By the above-described processings, the impeller 8 is formed.

In this embodiment, it is possible to prevent the contact of the blade 30 with respect to the inner peripheral surface 24*c* of the accommodation portion 24 even when the resin layer 31*a* of the shroud portion 31*b* contacts the inner peripheral surface 24*c* of the accommodation portion 24 during the rotation of the impeller 8. As a result, it is possible to prevent the wear damage of the blade 30. Further, since the resin layer 31*a* is softer than the metal material of the compressor casing 4, the wear damage of the accommodation portion 24 contacting the resin layer 31*a* may be also prevented. Further, since the resin layer 31*a* may be formed on the blade 30 of the impeller 8 that is smaller than the compressor casing 4 and is easily handled, the effort and the time in the manufacturing process may be reduced.

Further, in this embodiment, since the shroud portion 31*b* contacts the inner peripheral surface 24*c* of the accommodation portion 24, the gas compression efficiency of the compressor may be improved.

Since the resin layer 31*a* is formed in the radial facing portion 30*d* and the axial facing portion 30*e* of the outer edge 30*c* of the blade 30, the wear damage of the blade 30 and the accommodation portion 24 may be prevented even when the impeller 8 rotates while being deviated in position in any one of the radial direction and the axial direction.

Since a so-called resin lining is performed in which a thick resin layer is formed on the entire outer peripheral surface 50*b* of the base material 50*a*, the resin layer 31*a* of the shroud portion 31*b* may be easily formed compared to the case where the resin layer is formed on the outer edge of the blade after the blade is formed.

Furthermore, the embodiment disclosed herein is merely an example in every respect, and it should be considered that the embodiment does not limit the present invention. The scope of the present invention is illustrated in not the above-described embodiment but claims, and includes meanings equivalent to claims and all modifications within the scope.

In the above-described embodiment, the compressor has been described as an example of the rotary machine of the present invention, but the present invention may be applied to another rotary machine other than the compressor. For example, the present invention may be applied to a turbine. In this case, a turbine runner that rotates by a steam pressure corresponds to the blade wheel of the present invention.

The resin layer of the shroud portion does not need to be formed on the entire outer edge of the blade. For example, the resin layer may be formed on only the radial facing portion of the outer edge, only the axial facing portion, or only the radial facing portion and the axial facing portion.

The resin layer of the shroud portion may be formed so that at least a part thereof contacts the inner peripheral surface of the accommodation portion, and the entire thereof does not need to essentially contact the inner peripheral surface of the accommodation portion. Further, the shroud portion may be separated from the inner peripheral surface of the accommodation portion during the rotation of the impeller. The blade 30 may be formed as a member separated from the hub 28.

What is claimed is:

1. A rotary machine, comprising:

a casing; and a blade wheel that is rotatably provided inside the casing such that the blade wheel is able to rotate relative to the casing, wherein the blade wheel includes:

a blade that extends toward an inner peripheral surface of the casing and terminates at an edge that faces the inner peripheral surface of the casing and that is able to rotate relative to the inner peripheral surface of the casing; and a shroud portion provided in at least a part of the edge of the blade facing the inner peripheral surface of the casing, wherein a resin layer is provided only at the shroud portion and only at a portion of the outer edge of the blade facing the inner peripheral surface of the casing with a gap of a constant size, wherein the portion of the edge of the blade having the resin layer provided thereon has a shape following the inner peripheral surface of the casing.

2. The rotary machine according to claim 1, wherein the shroud portion is provided at the entire edge of the blade.

3. The rotary machine according to claim 1, wherein at least a part of the shroud portion contacts the inner peripheral surface of the casing.

4. The rotary machine according to claim 1, wherein the edge of the blade includes a radial facing portion that faces the inner peripheral surface of the casing in the radial direction of the blade wheel, and the radial facing portion is provided with the shroud portion.

5. The rotary machine according to claim 1, wherein the edge of the blade includes an axial facing portion that faces the inner peripheral surface of the casing in the axial direction of the blade wheel, and the axial facing portion is provided with the shroud portion.

6. A blade wheel that is used in the rotary machine according to claim 1.

* * * * *